US007004605B1

(12) United States Patent
Galvez

(10) Patent No.: US 7,004,605 B1
(45) Date of Patent: Feb. 28, 2006

(54) DROP-LIGHT APPARATUS

(75) Inventor: James M. Galvez, San Dimas, CA (US)

(73) Assignee: National Electric Manufacturing Corporation, Commerce, CA (US)

( * ) Notice: Subject to any disclaimer, the term of this patent is extended or adjusted under 35 U.S.C. 154(b) by 134 days.

(21) Appl. No.: 10/740,966

(22) Filed: Dec. 22, 2003

Related U.S. Application Data

(63) Continuation-in-part of application No. 10/438,430, filed on May 15, 2003, now Pat. No. 6,902,295.

(51) Int. Cl.
*F21V 17/00* (2006.01)

(52) U.S. Cl. ..... 362/451; 362/260; 362/369; 362/390; 362/249; 362/225; 362/240

(58) Field of Classification Search ..... 362/216, 362/217, 220–225, 260, 306, 369, 390, 394, 362/249, 451, 320, 360, 240, 362
See application file for complete search history.

(56) References Cited

U.S. PATENT DOCUMENTS

| | | | | |
|---|---|---|---|---|
| 1,839,937 | A * | 1/1932 | Venner, Jr. | 362/255 |
| 2,382,538 | A * | 8/1945 | Biller | 362/217 |
| 2,864,067 | A * | 12/1958 | Grovemiller et al. | 439/11 |
| 5,117,345 | A * | 5/1992 | Baake | 362/390 |
| 5,860,730 | A * | 1/1999 | Hesprich | 362/640 |
| 6,135,613 | A * | 10/2000 | Bodell et al. | 362/223 |
| 6,663,265 | B1 * | 12/2003 | Kovacik et al. | 362/375 |

* cited by examiner

*Primary Examiner*—Sandra O'Shea
*Assistant Examiner*—Sharon Payne
(74) *Attorney, Agent, or Firm*—William W. Haefliger

(57) ABSTRACT

An illumination device comprising, in combination an elongated housing, an elongated lamp or lamps extending in the housing, a magnetic ballast or ballasts carried in the housing to selectively energize the lamp or lamps, and switch means carried by the housing to control energization of said ballast or ballasts, the housing having a forward illumination portion, a rearward grip portion and an intermediate portion. A cushioning cover is receivable over two of said housing portions.

25 Claims, 6 Drawing Sheets

10
60
11e
26
27
26a
27a
29
31
34
35
36
28
30
68
22
15b
11c
18
17
15
15a
11d
5
6
7
20
19
11a
12
40
16

34
11b
11a
35
36

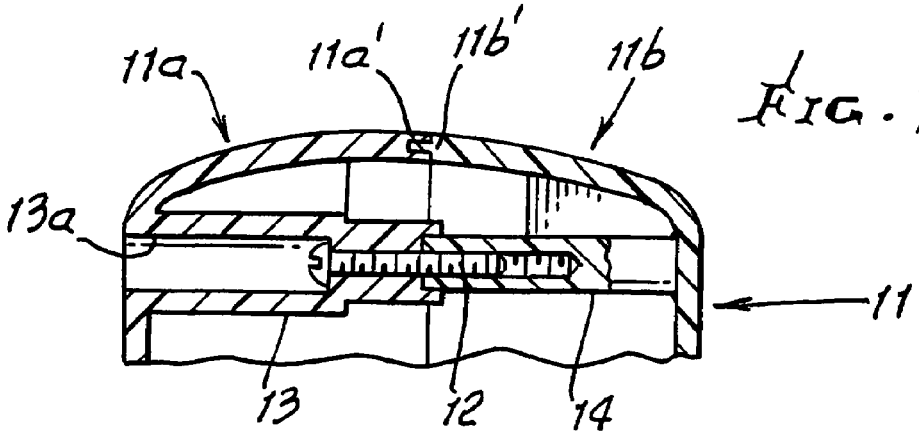
FIG. 7.
FIG. 8.
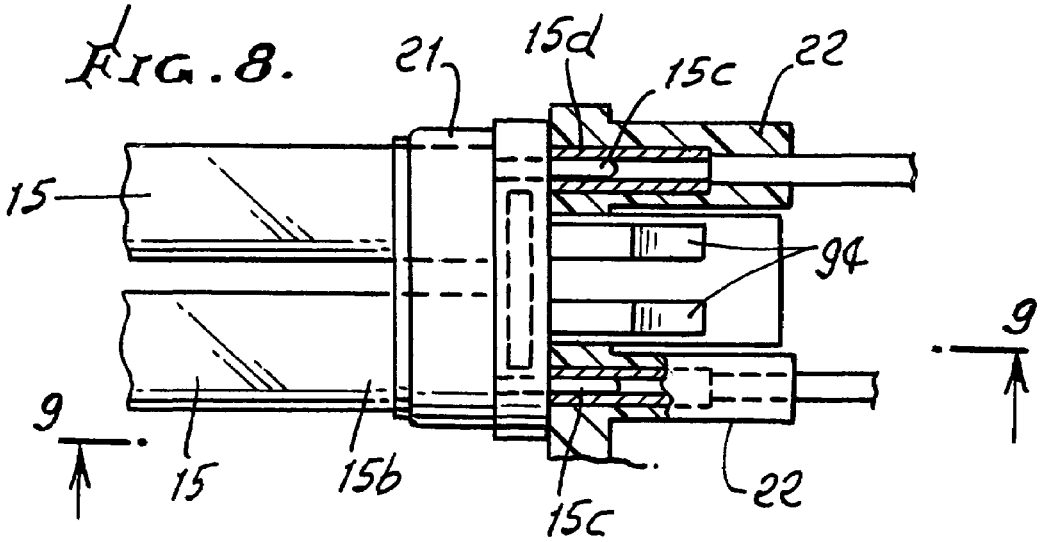
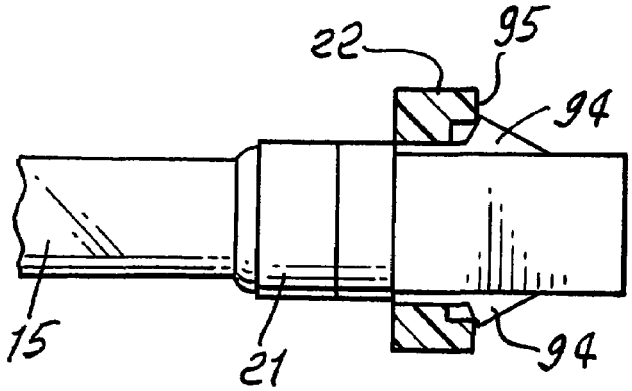
FIG. 9.

DROP-LIGHT APPARATUS

This application is a continuation-in-part of Ser. No. 10/438,430, filed May 15, 2003 now U.S. Pat. No. 6,902, 295.

BACKGROUND OF THE INVENTION

This invention relates generally to portable illumination devices and more particularly to an improved device wherein a bulb or lamp, or lamps, are energized by magnetic ballast or ballasts.

There is need for improvements in portable illumination devices wherein complexity of electrical circuitry required for power supply to lamps is reduced, and wherein unreliability of such power supply is also reduced. There is also need for an improved device employing magnetic ballast or ballasts, as well as a device having improvements in structure and functions as will be seen.

Also there is need for cushioning protection of the above apparatus.

SUMMARY OF THE INVENTION

It is a major object of the invention to provide for improvements in portable illumination devices as referred to. Basically, the device comprises:

a) an elongated housing, b) at least two elongated lamps extending in the housing, c) one or preferably two magnetic ballasts carried in the housing to selectively energize the lamps, d) switch means carried by the housing to control energization of said one or two ballasts, e) and cushioning means for housing protection.

As will be seen, the housing typically has a forward illumination portion, a rearward grip portion and an intermediate portion, and wherein the lamp or lamps are carried at said forward portion, one of said two magnetic ballasts is carried at said intermediate portion, and the other of said two ballasts is carried at said rearward portion, enhancing weight distribution and ease of handling. Magnetic ballasts are significant weight adding devices, and their separation adds to manual control. One ballast may control one lamp, and the other ballast may control a second lamp, whereby at least one lamp will remain energized by a ballast if the other ballast fails. The lamps are typically fluorescent.

Another object is to provide improved cushioning support for the housing forward illumination portion.

Yet another object comprises optimum positioning of two ballasts in separate housing sections for weight distribution, and for hand gripping close to the magnetic ballasts. In this regard, ballast edge locating elements are provided in the housing sections, and may be molded into plastic housing shell sections.

An added object is to locate the ballasts out of the reflected light transmission path or paths from the lamps, as will be seen.

These and other objects and advantages of the invention, as well as the details of an illustrative embodiment, will be more fully understood from the following specification and drawings, in which:

DRAWING DESCRIPTION

FIG. 7 is a section taken on lines 7—7 of FIG. 3;

FIG. 8 is an enlarged plan view showing the lamps terminal and socket assembly;

FIG. 9 is a view taken on lines 9—9 of FIG. 8;

Figure 1:
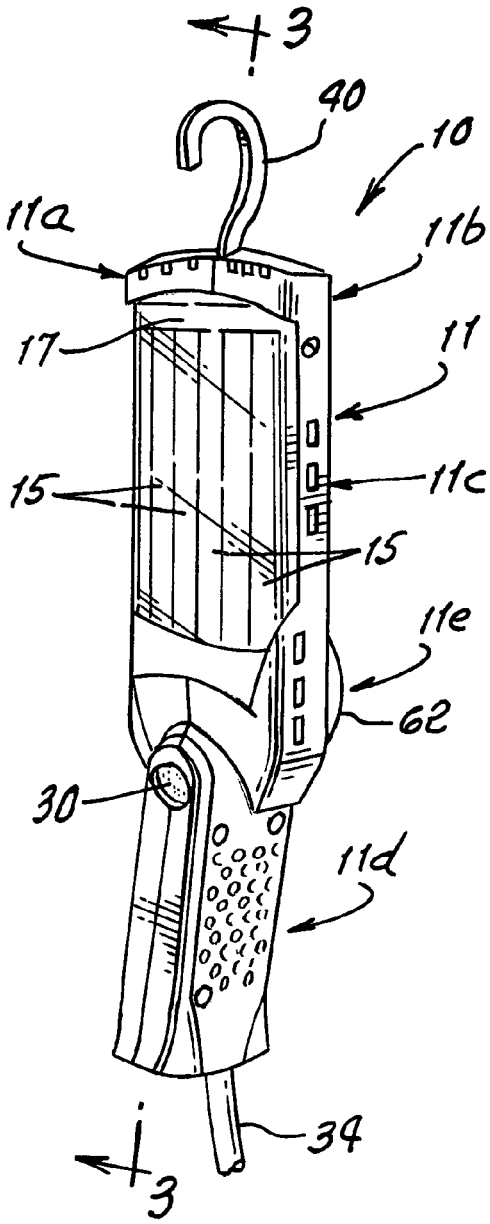
FIG. 1 is an elevation view, in perspective, showing the front side of the illumination device.
Figure 2:
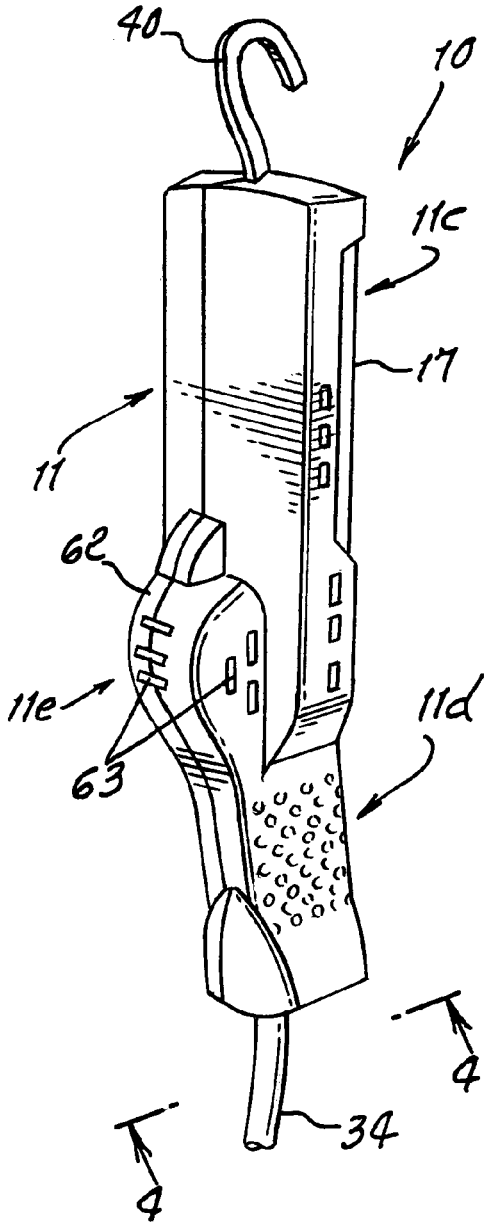
FIG. 2 is a view like FIG. 1, but showing the rear side of the device.
Figure 10:
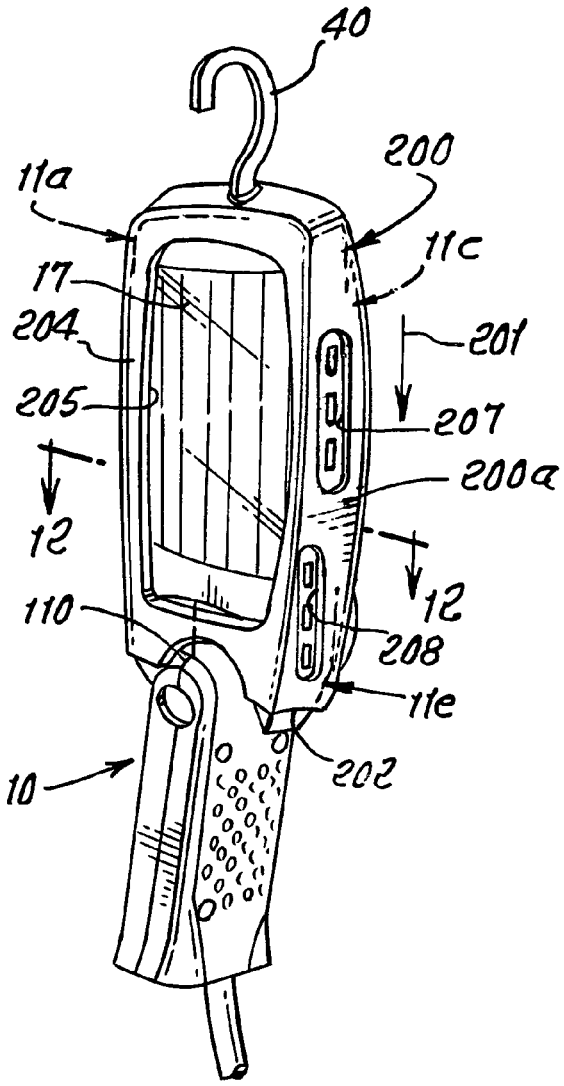
Figure 11:
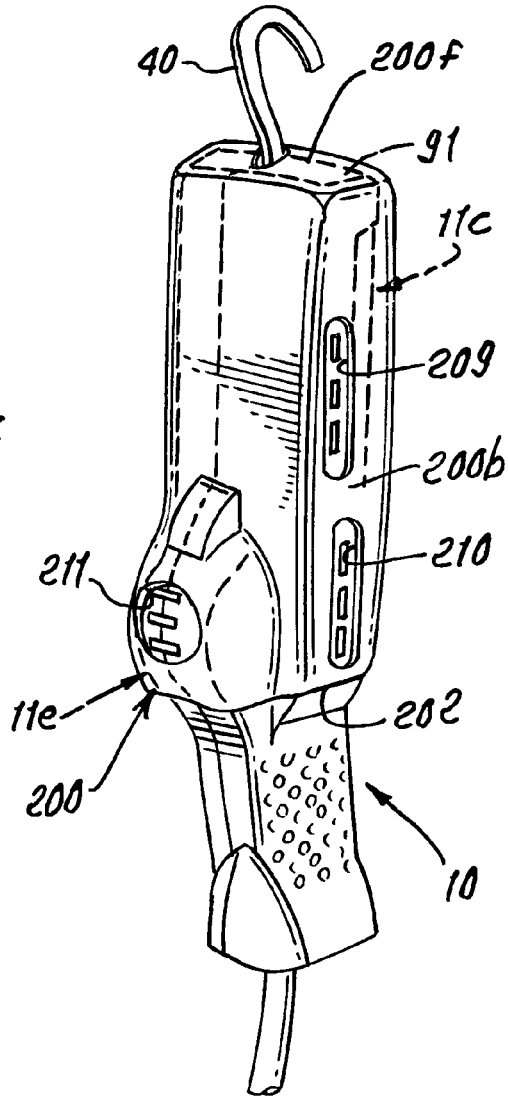
Figure 12:
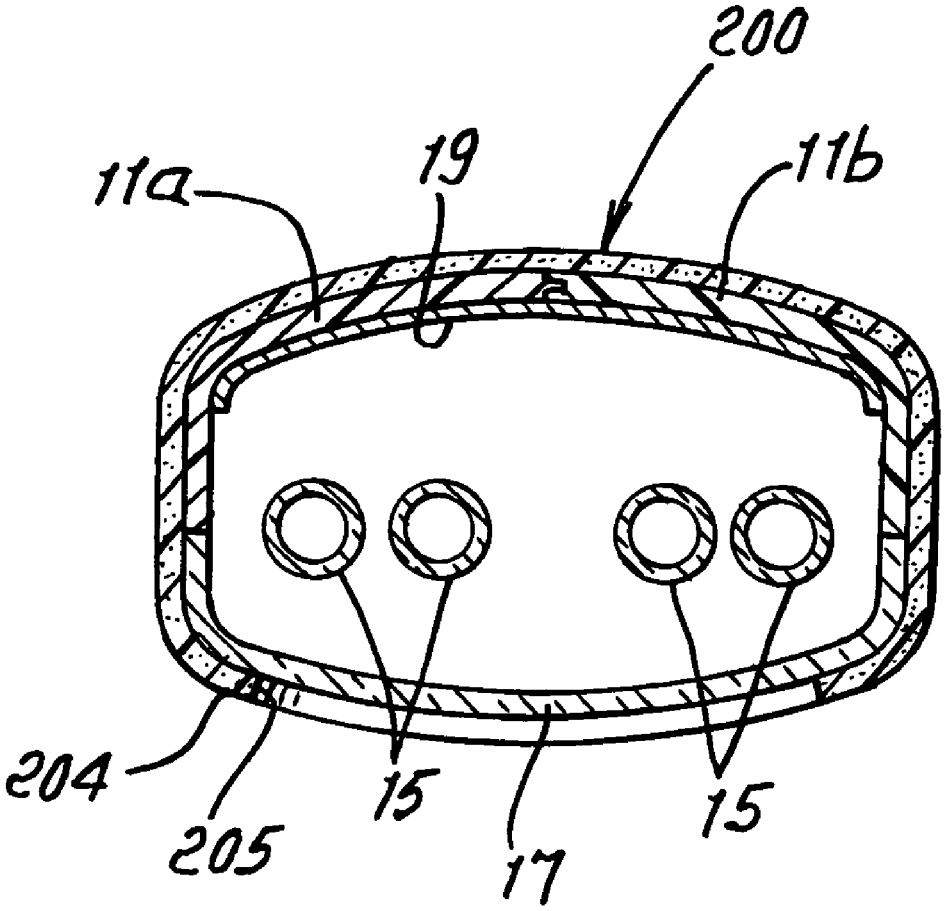

FIGS. 10 and 11 are like FIGS. 1 and 2, but show provision of a cushioning protector on the forward portion of the housing; and FIG. 12 is a section taken on lines 12—12 of FIG. 10.

DETAILED DESCRIPTION

The preferred illumination device 10 includes an elongated housing 11 which may consist of two complementary molded plastic shell sections 11*a* and 11*b*, each extending throughout the length of the housing. Screw fasteners 12 hold the sections together, as for example is indicated in FIG. 7. A screw 12 interconnects two posts 13 and 14 respectively molded in and to sections 11*a* and 11*b*. The screw head is typically protectively received in a recess 13*a* of post 13. Section edges 11*a* and 11*b* are held together as shown. Other means to interconnect the sections may be provided.

The two sections of the housing together define a housing forward illumination portion 11*c*, a rearward grip portion 11*d*, and an intermediate portion 11*e*. At least two elongated lamps or bulbs 15 are carried to extend endwise in the hollow interior 16 of the housing forward portion 11*c*, and so as to face a window or lens 17 peripherally carried by the housing sections 11*a* and 11*b*, as is also clear form FIG. 1. Two pairs of such lamps 15 are shown in FIG. 1, and substantially filling, widthwise, the interiors defined by the two housing sections, for maximum light transmission in the sideward direction indicated by arrow 18 in FIG. 3, and through transparent lens or window 17. A reflector 19 is provided at the sides of the lamps opposite the lens, and may consist of a reflecting paper or other material.

Figure 3:
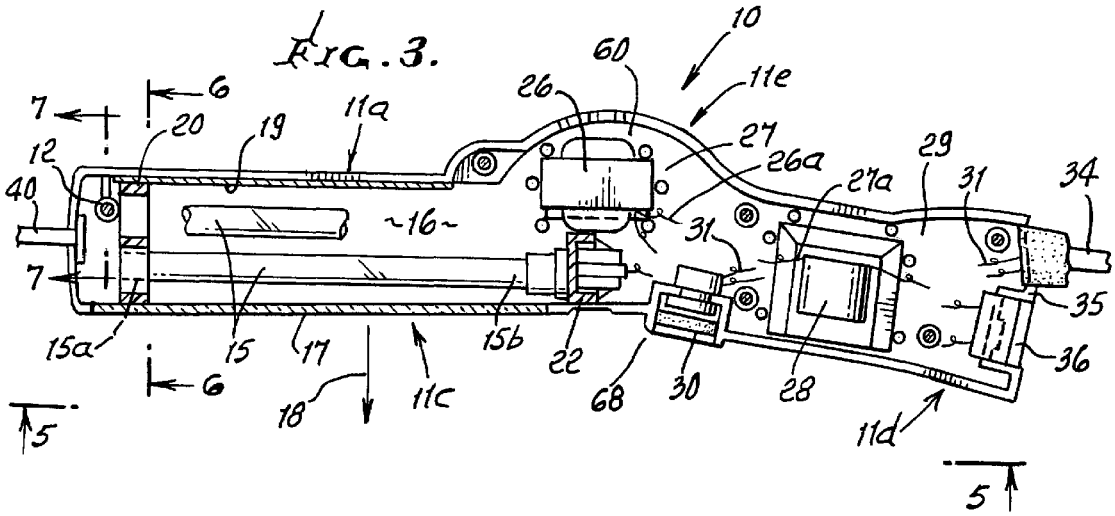
FIG. 3 is an enlarged section taken on lines 3—3 of FIG. 1.
Figure 4:
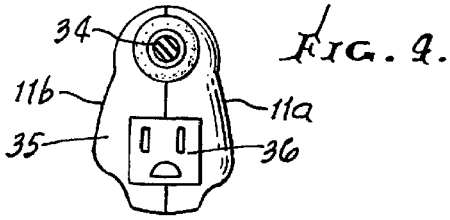
FIG. 4 is a bottom plan view taken on lines 4—4 of FIG. 2.
Figure 5:
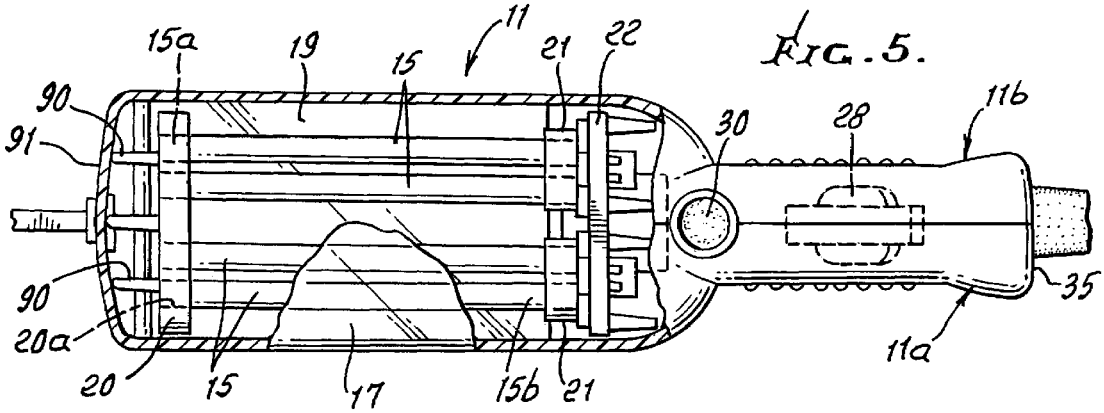
FIG. 5 is a frontal view, taken on line 5—5 of FIG. 3, and partly broken away to show interior construction.
Figure 6:
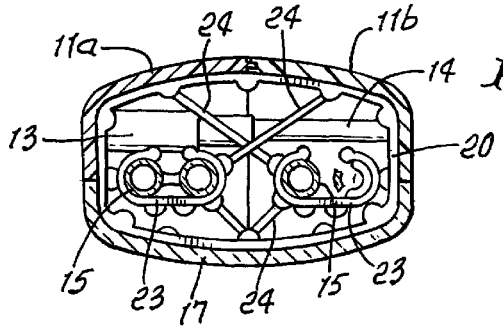
FIG. 6 is a section taken on lines 6—6 of FIG. 3.

The lamps 15 have distal end portions 15*a* received in openings 20*a* in cushioning holder or holders 20 that endwise seat the lamps. Such holder or holders may consist of elastomeric material, such as rubber or molded plastic, carried by the housing forward portion as seen in FIG. 3. Spikes 90 carried by holder 20 project toward end walls 91 of the housing, to position the holder and lamp ends, endwise. The opposite end portions 15*b* of the lamps are carried by a plug or plugs 21 as seen in FIG. 8, and have electrical terminal pins 15*c* projecting into electrical sockets 15*d* carried within elastomeric holder or holders 22. Mounting holders or clips are shown at 23 in FIGS. 6 and 8, there being two U-shaped holders or clips 23, each carrying two of the lamp end portions, or their holders. Note in FIG. 6 the web structure 24 formed in the housing interior and positioning the two holders or clips 23, within 22. Spikes 94 on 22 project toward housing wall 95 to position holder 22.

Also provided are at least one, and preferably two magnetic ballasts carried in the housing to energize the lamp or lamps, which are typically fluorescent. Two such ballasts are shown, one indicated at 26 within the hollow interiors 27 of the housing sections at the intermediate portion 11*e* of the housing, and the other indicated at 28 within the hollow interiors 29 of the housing sections and inwardly of the rearward grip portion 11*d* of the housing for ease of handling. One ballast is shown as electrically connected to one lamp associated with one holder or clip 23; and the other ballast is shown as electrically connected to the other lamp associated with the other holder or clip 23. See wiring at 26*a* and at 27*a*. Each lamp holder 20 and 22 is typically U-shaped, or H-shaped to assemble the lamps. This enables power supply to both lamps, and if one ballast fails to operate for any reason, the other ballast remains operative to supply power to its associated lamp.

An ON-OFF switch 30 in series with an AC power supply line 31 controls ON-OFF power supply to the two ballasts. The cable or cord for line 31 is shown as connecting at 34 to the end 35 of the grip portion lid of the housing. An auxiliary power receptacle 36 is also provided at the housing end 35 to supply power from line 31 to a plug that may be inserted into receptacle 36, as for power supply to another similar illumination device, if desired, or to other equipment. A hook 40 is carried at the forward end of the device to hang or support the device, from other structure, as at a work place.

It will be noted that the two ballasts are separated, for weight distribution along the length of the device 10, and for weight concentration toward the manual grip end of the device, facilitating case of transport and maneuver of the device. Ballast 26 is located within a domed interior 60 of the housing, covered by housing device 62, vented at 63.

Ballasts of the type shown are known, one example being Models 013 and 015, produced by Robertson Ballast Company, of Chicago, Ill.

In a typical example, the device incorporates two 13-watt lamps, which withstand heavy usage and frequent device drops. The lamps may provide 26 watts of light energy, which is equivalent to 120+ watts of incandescence, so that an entire large work area can be illuminated. The body or housing is made of the durable plastic material. The ratcheting or detent hanging hook directs light to where needed, and the heavy duty (for example 3 conductor) cord withstands all normal shop usage. The unique push button switch prevents accidental on/off operation when working, as it is located in a shallow V-shaped recess 68 defined by the housing. Housing portion 1*d* is angled at between about 50 and 150 relative to housing portion 11*c*, thereby creating recess 68.

Referring to FIGS. 10–12 a protective flexible shroud-like cover 200 is shown as received in position on or partially over the housing forward illumination portion 11*c*, shown in FIGS. 1 and 2. The cover is stretchably endwise received in direction 201 in the illustrated position, and has an open end 202 that fits or assembles closely over the hook 40 and housing formed portion 11*a* as well as into or over the housing intermediate portion 11*e* that bulges sidewardly, as shown, whereby cover retention is assured. The covers defines a holder for two sections of the housing at opposite sides of the split 110.

FIG. 12 shows the cover looping edge 204 defining an opening 205 in registration with the window or lens 17, to pass light to the exterior. Cover thickness (⅛ to ⅜ inch, for example) adjacent edge 204 serves to protect the lens, with cushion effect, in case the device impacts a hard surface, at the lens side, or other sides. Tight fitting of the cover about the thin housing sections holds them in edge-to-edge stable position. See FIG. 12. Housing bulging intermediate portion 11*e* holds the cover in endwise position and helps prevents cover sidewise misalignment relative to lens 17.

The cover also has through openings at 207, 208, 209, 210 and 211 as shown, to vent lamp produced heat to the exterior. The narrow openings or vents 207–210 are elongated, and located at cover opposite sides 200*a* and 200*b*. The cover end 200*f* fits adjacent the top end 91 of the housing forward portion 11*c*.

The shroud-like cover may consist of flexible, resiliently compressible, and stretchable plastic material, such as a suitable elastomer.

One example of the above lamp or lamps is known as PL-13 size lamp.

The invention claimed is:

1. An illumination device comprising, in combination:

a) an elongated housing, b) an elongated lamp or lamps extending in the housing, c) a magnetic ballast or ballasts carried in the housing to selectively energize the lamp or lamps, d) and switch means carried by the housing to control energization of said ballast or ballasts, e) said housing having a forward illumination portion, a rearward grip portion and an intermediate portion, and f) a cushioning cover received on said housing forward portion, g) said housing forward portion having a transparent side window facing said lamp or lamps, and said cover has an opening retained in registration with said window, h) said cover having the shape of a shroud that extends at the housing intermediate portion.

2. The combination of claim 1 wherein said intermediate portion defines a sideward bulge, and said cover fits closely over said bulge acting to retain the cover in position.

3. The combination of claim 1 wherein said cover has multiple through openings to vent heat from the housing, produced by lamp energization.

4. The combination of claim 1 wherein said lamp or lamps have a distal end portion or portions, said cushioning cover carried by the housing, and extending proximate said lamp distal end portion or portions.

5. The combination of claim 4 wherein said cushioning cover comprises an elastomer.

6. The combination of claim 5 wherein said elastomer defines a holder or holders peripherally carried by two sections of the housing, held in edge-to-edge interfit position.

7. The combination of claim 4 wherein the housing defines a side opening, there being a solid transparent window at said side opening and facing said lamp or lamps, and there being a reflector or reflectors at the side of the lamp or lamps opposite said window, said window recessed inwardly relative to the outer surface of said cushioning means cover proximate the window.

8. The combination of claim 1 wherein said lamp or lamps is or are fluorescent lamps.

9. The combination of claim 1 wherein the lamp or lamps are carried at said forward portion, one of two ballasts is carried at said intermediate portion, and the other of said two ballasts is carried at said rearward portion.

10. The combination of claim 1 wherein the cover consists of a resiliently compressible and stretchable elastomer.

11. The combination of claim 1 including a lamp holder in the housing consisting of elastomeric or plastic material defining web structure forming a lamp receiving opening or openings.

12. The combination of claim 11 including spikes carried by the holder and projecting toward a housing wall or walls to position the holder in the housing.

13. An illumination device comprising, in combination:

a) an elongated housing, b) an elongated lamp or lamps extending in the housing, c) a magnetic ballast or ballasts carried in the housing to selectively energize the lamp or lamps, d) and switch means carried by the housing to control energization of said ballast or ballasts, e) said housing having a forward illumination portion, a rearward grip portion and an intermediate portion, f) a cushioning cover received on said housing forward portion, g) and wherein the housing defines a side opening, there being a solid transparent window at said side opening and facing said lamp or lamps, said cover defining a through opening in registration with said window, and otherwise covering substantially the entirety of said housing forward portion.

14. An illumination device comprising, in combination:

a) an elongated housing, b) an elongated lamp or lamps extending in the housing, c) a magnetic ballast or ballasts carried in the housing to selectively energize the lamp or lamps, d) and switch means carried by the housing to control energization of said ballast or ballasts, e) said housing having a forward illumination portion, a rearward grip portion and an intermediate portion, f) a cushioning cover received on said housing forward portion, g) and wherein said switch means includes a push button at a side of said intermediate portion of the housing which defines a shallow V-shaped recess, said cover extending into proximity to said push button.

15. The combination of claim 14 wherein said push button is at the same side of the housing as an opening defined by said cushioning cover.

16. An illumination device comprising, in combination:

a) an elongated housing, b) an elongated lamp or lamps extending in the housing, c) a magnetic ballast or ballasts carried in the housing to selectively energize the lamp or lamps, d) and switch means carried by the housing to control energization of said ballast or ballasts, e) said housing having a forward illumination portion, a rearward grip portion and an intermediate portion, f) a cushioning cover received on said housing forward portion, g) and wherein said intermediate portion defines an outward bulge, said cover stretchably received over said bulge.

17. The combination of claim 16 including lamp holders at opposite ends of the lamps, and spikes on the holders engageable with housing walls to position the lamps endwise in the housing, and in spaced relation to the one or two ballasts.

18. For use on an illumination device that includes an elongated housing, an elongated lamp or lamps extending in the housing, and the housing defining a window in registration with the lamp or lamps, the combination comprising a) a protective flexible cover configured for assembly over at least part of the housing, b) the cover defining a main opening to be assembled in registration with said housing window, c) the cover having multiple auxiliary openings to vent heat from the housing, produced by lamp energization, d) the cover having the form of a receptacle with front and rear walls, opposite ends, and side walls, said main opening formed in said front wall, and certain of said multiple openings formed in said side walls.

19. The combination of claim 18 wherein said side walls taper toward one of said cover opposite ends which is open to be assembled over the housing.

20. The combination of claim 18 wherein said protective cover defines a cushioning means for the housing.

21. The combination of claim 20 wherein said cushioning means comprises a resiliently compressible and stretchable elastomer.

22. The combination of claim 20 including said housing received endwise by said cover which is stretchably retained on the housing.

23. The combination of claim 18 wherein said certain openings in said sidewalls are elongated in the direction of cover elongation.

24. The combination of claim 22 including a lamp holder in the housing consisting of elastomeric or plastic material defining web structure forming a lamp receiving opening or openings.

25. The combination of claim 24 including spikes carried by the holder and projecting toward a housing wall or walls to position the holder in the housing.

* * * * *